US005311642A

United States Patent [19]

Tillmann et al.

[11] Patent Number: 5,311,642

[45] Date of Patent: May 17, 1994

[54] DOOR CLOSER WITH A DETENT FOR HOLDING A DOOR OPEN AND THE DETENT THEREFOR

[75] Inventors: Horst Tillmann; Dietrich Jentsch, both of Ennepetal; Thomas Hering, Wetter; Thomas Warschewitz, Ennepetal; Dieter Sichelschmidt, Herdecke; Bernd Winkler, Breckerfeld, all of Fed. Rep. of Germany

[73] Assignee: Dorma GmbH + Co. KG, Ennepetal, Fed. Rep. of Germany

[21] Appl. No.: 931,281

[22] Filed: Aug. 17, 1992

Related U.S. Application Data

[63] Continuation of PCT/DE90/00962, Dec. 13, 1990.

[30] Foreign Application Priority Data

Feb. 20, 1990 [DE] Fed. Rep. of Germany ..... 4005203

[51] Int. Cl.[5] ..... E05F 3/00; E05D 15/58; E05C 17/04

[52] U.S. Cl. ..... 16/65; 16/86 B; 16/DIG. 17; 292/275

[58] Field of Search ..... 16/65, 70, 80, 86 B, 16/DIG. 17; 292/275, 268

[56] References Cited

U.S. PATENT DOCUMENTS

| | | | |
|---|---|---|---|
| 1,101,859 | 6/1914 | Lambert | 292/275 |
| 1,942,860 | 1/1934 | Hummert . | |
| 3,164,032 | 1/1965 | Abbey . | |
| 3,986,742 | 10/1976 | Heaney . | |
| 4,506,407 | 3/1985 | Downey | 16/DIG. 17 |

FOREIGN PATENT DOCUMENTS

| | | |
|---|---|---|
| 1432653 | 9/1965 | France . |
| 2018887 | 10/1979 | United Kingdom . |

*Primary Examiner*—David Jones
*Assistant Examiner*—Carmine Cuda
*Attorney, Agent, or Firm*—Nils H. Ljungman & Associates

[57] ABSTRACT

A door closer being affixable to a door for closing the door. A channel having a slide therein for engaging with a detent also in the channel for holding the door open. The slide is connected to an arm of the door closer which arm moves the slide along the channel into contact with the detent which holds the door open once the detent and the slide have engaged with one another.

14 Claims, 8 Drawing Sheets

Fig. 10
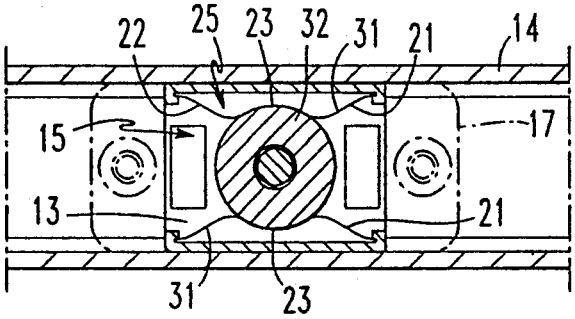
Fig. 11
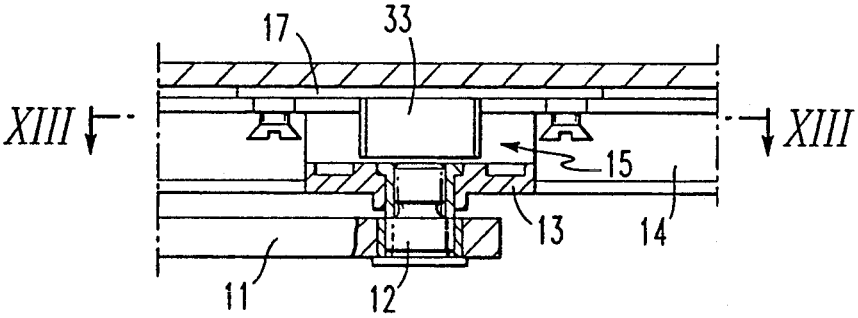
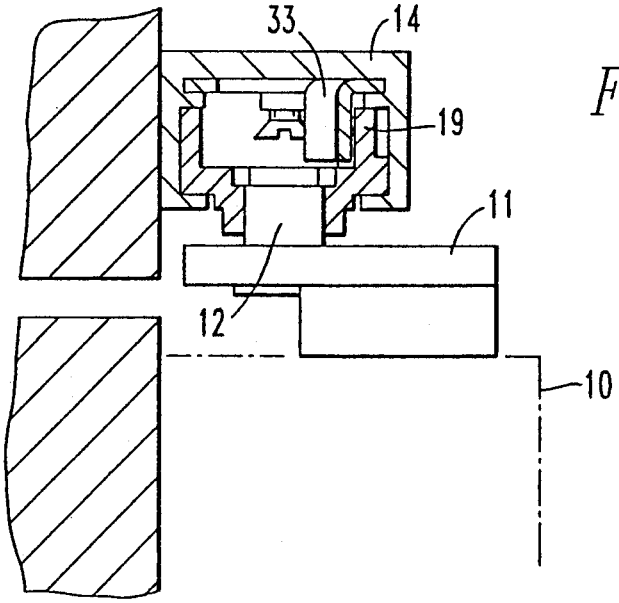
Fig. 12

Fig. 13
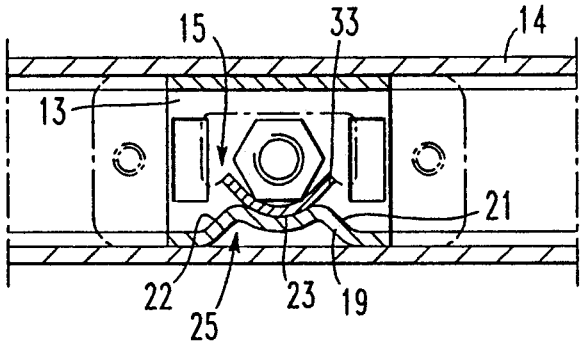
Fig. 14
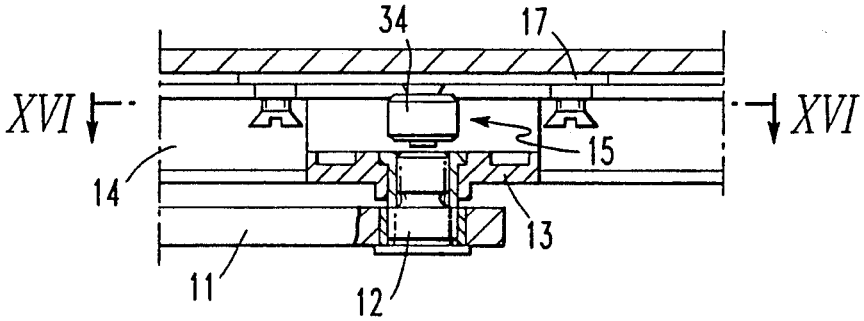
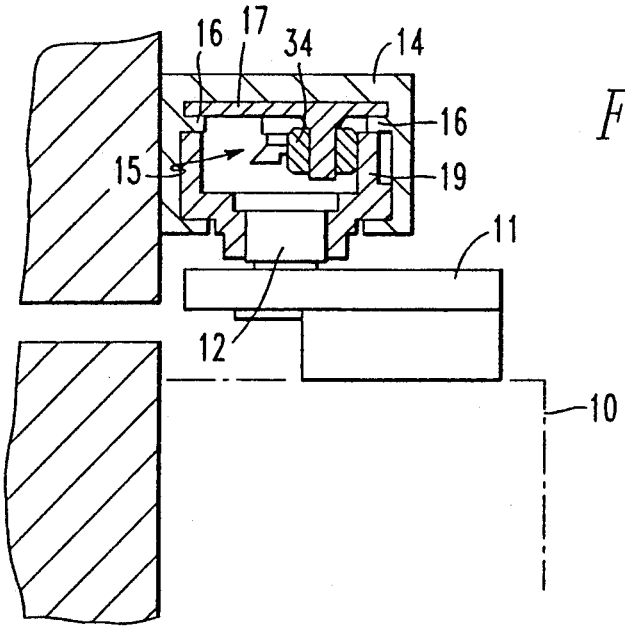
Fig. 15

DOOR CLOSER WITH A DETENT FOR HOLDING A DOOR OPEN AND THE DETENT THEREFOR

This application is a continuation of PCT/DE90/00962, filed Dec. 13, 1990.

BACKGROUND OF THE INVENTION

1. Field of the Invention

This invention relates to a fixing device for door panels with a door closer, the closer shaft of which is coupled to one end of a swivel arm, the other end of which is engaged by means of a slide so that it can move longitudinally in a guide rail. The slide together with an abutment fastened to the guide rail forms a holding unit to fix the door panel connected to the swivel arm, whereby the holding unit comprises an overthrusting, automatically yielding and resetting holding element.

2. Background Information

On fixing devices of the prior art, a holding element in the form of a spring-loaded pivoting lever, the travel of which can be limited, is mounted on the abutment fastened to the guide rail. The pivoting lever has a retaining cam for a pin of the slide which may cross the holding element. For its part, the slide is mounted so that it can move longitudinally in the guide rail, and is connected to the free end of the swivelling arm of a door closer. On such fixing devices of the prior art, the swivelling lever forming the holding element is essentially located above the slide in the guide rail, and for this reason, and on account of the spring mounting or suspension of the swivelling lever and the limitation of the swivelling lever travel, the guide rail must be relatively tall. In addition to this uneconomical configuration of the guide rail, the fixing device itself is a relatively expensive part to manufacture.

OBJECT OF THE INVENTION

The object of this invention is to improve a fixing device of the type described above so that a compact construction is possible, using a few, simple components, and the fixing device being subjected to almost no wear.

SUMMARY OF THE INVENTION

This object is achieved by one embodiment of the invention, in that, the holding element has a spring-mounted leg with a leading bevel and a trailing bevel, which are interrupted by a notch or catch. It is thereby possible to reduce the number of components, and to locate the essential components of the fixing device inside the slide, which preferably has an essentially U-shaped cross section.

In one preferred embodiment of the invention, the abutment is designed as a flat piece fastened to the guide rail, which has two legs designed as essentially isosceles triangles, which are oriented with the tips of their legs forming the notch transverse to the longitudinal axis of the guide rail, enclosing between them an elastic buffer element which cushions the leg, and by means of which the catches on the leg, when the door is fixed, are held in notches on the inside surfaces of the side walls of the slide. In this manner, it is possible to form a compact abutment, on which the two legs opposite one another are guided transverse to the longitudinal direction of the guide rail, and project into the path of movement of the slide. The location of the leg, which can be displaced in relation to the buffer element, also makes it possible for the slide to travel over the abutment, although the slide is exactly positioned when the door is fixed.

The buffer element is preferably designed as a cylindrical disc, which is supported in recesses of each leg, which expand into a cylindrical hole. To achieve a hard elastic buffer element, the buffer element can have a central hole, in which is located a non-elastic pin which fills the hole. So that the action of the buffer element acts at the point on the legs where, when the door is fixed, they come in contact with the slide, the buffer element is preferably located exclusively in the area of action of the side walls of the slide acting on the leg when the door is fixed.

An additional embodiment of the invention according to the object of the invention can be achieved by forming the holding element by means of elastic legs forming side walls of the slide, which with their notches, when the door is fixed, surround a rhomboid or diamond-shaped projection of the flat piece abutment in certain areas. In an additional embodiment of the invention, the legs of the holding element, however, can also be designed as leaf springs fastened to both sides of the slide, and these springs, with their notches, can surround portions of a hard elastic circular disc mounted on the abutment.

An additional embodiment of the invention according to the object of the invention can be formed if the slide has an elastic leg only on one side, in whose notches, when the door is fixed, an angular leg projecting from the flat piece abutment is engaged.

The embodiment of the invention according to the invention described immediately above can be modified by having the slide have an elastic leg only on one side, in whose notches, when the door is fixed, a hard elastic roller mounted on the flat piece abutment is engaged. Other embodiments of the invention may be modified such that only one recess is used instead of two.

BRIEF DESCRIPTION OF THE DRAWINGS

The invention is explained in greater detail below, with reference to the embodiments illustrated schematically in the accompanying drawings.

FIG. 10 shows the holding unit illustrated in FIG. 8 in a horizontal section along Line X—X in FIG. 8.

FIG. 11 shows an additional embodiment of the holding unit of a fixing device, in a vertical section as in FIGS. 2, 5 and 8.

FIG. 12 shows the holding unit illustrated in FIG. 11 in a cross section.

FIG. 13 shows the holding unit illustrated in FIG. 11, in a horizontal section along Line XIII—XIII in FIG. 11.

FIG. 14 shows the holding unit in an additional embodiment, in a vertical section as illustrated in FIGS. 2, 5, 8 and 11.

FIG. 15 shows the holding unit illustrated in FIG. 14, in cross section.

DESCRIPTION OF THE PREFERRED EMBODIMENTS

Figure 1:
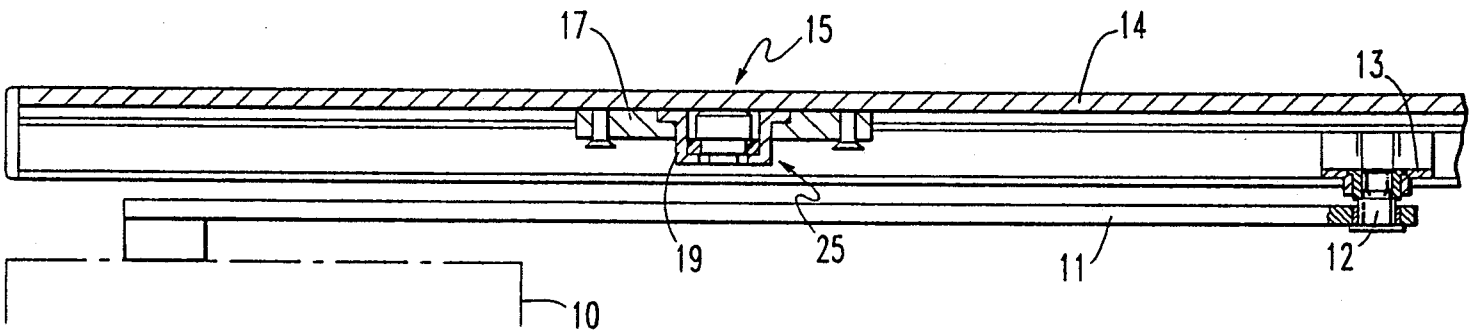
FIG. 1 shows the fixing device in a cross section view, with an abutment fastened to the guide rail, and a slide which can move longitudinally in the guide rail coupled to the free end of the swivelling arm, in its movement position.

FIG. 1 shows a swivel arm 11, which is torsionally connected on one side to the swivelling shaft of a door closer 10 indicated in dashed lines and fastened, for example, to a door panel (not shown). The other end of this swivel arm 11 is mounted on a pin 12, which is preferably permanently connected to a slide 13, which in turn is located so that it can move longitudinally in a guide rail 14 fastened above the door panel. In the guide rail 14, in a position corresponding to the open position of the door panel, there is an abutment 15, fastened, e.g. by form-fitting, in the guide rail 14, which together with the slide 13 acts as a holding unit to fix the door panel in its open position.

The guide rail 14 preferably has a C-shaped cross section which is open on the bottom, and in its upper area has two strip-like projections 16 opposite one another, which together with the upper wall of the guide rail 14, form a groove to hold a flat piece 17 which can be braced inside it.

Figure 1A:
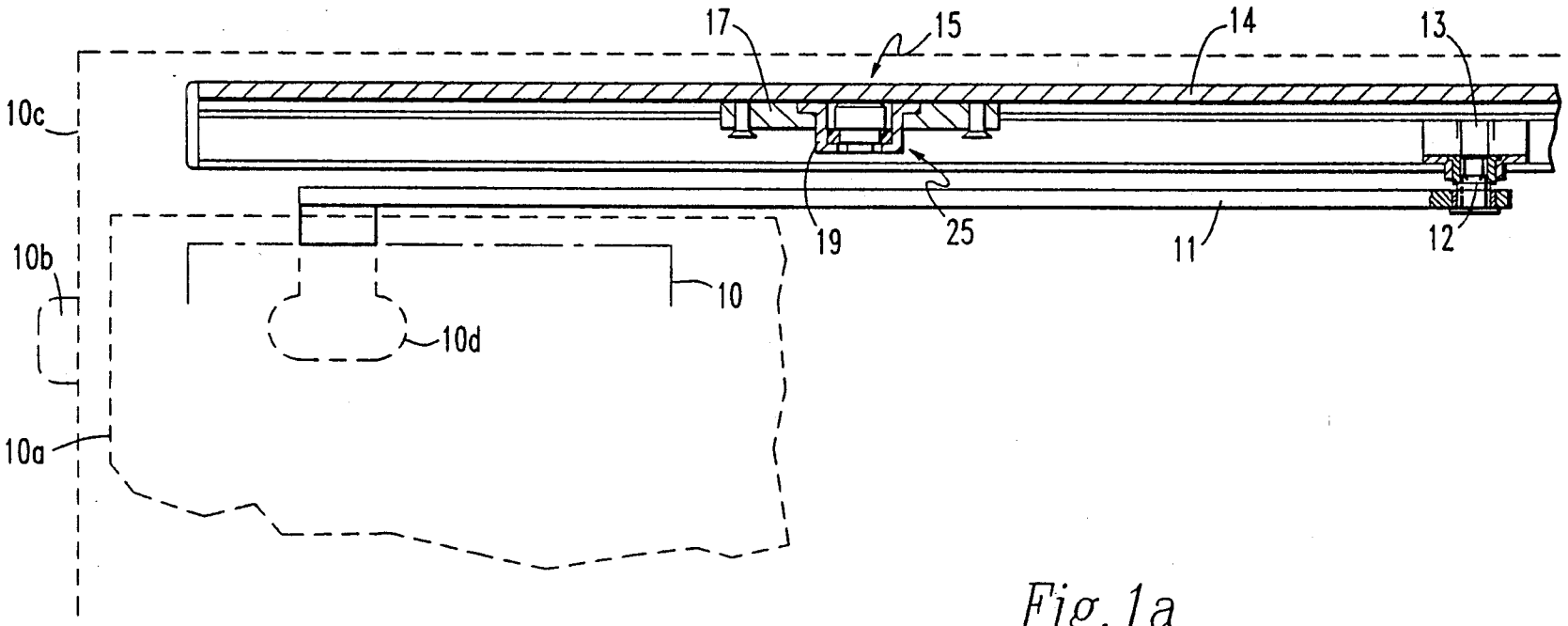
FIG. 1*a* shows the fixing device in a cross section view, with an abutment fastened to the guide rail, and a slide which can move longitudinally in the guide rail coupled to the free end of the swivelling arm, in its movement position.

FIG. 1*a* shows a swivel arm 11, which is torsionally connected on one side to the swivelling shaft of a door closer 10 indicated in dashed lines and fastened, for example, to a door panel 10*a*. The other end of this swivel arm 11 is mounted on a pin 12, which is preferably permanently connected to a slide 13, which in turn is located so that it can move longitudinally in a guide rail 14 fastened above the door panel. In the guide rail 14, in a position corresponding to the open position of the door panel, there is an abutment 15, fastened, e.g. by form-fitting, in the guide rail 14, which together with the slide 13 acts as a holding unit to fix the door panel in its open position.

Hinges 10*b* hold the door 10*a* in a door jamb or frame 10*c*. The door closer 10 includes motor apparatus 10*d* preferably either hydraulic or pneumatic, for acting upon the swivel arm 11 for closing the door 10*a*.

Figure 2:
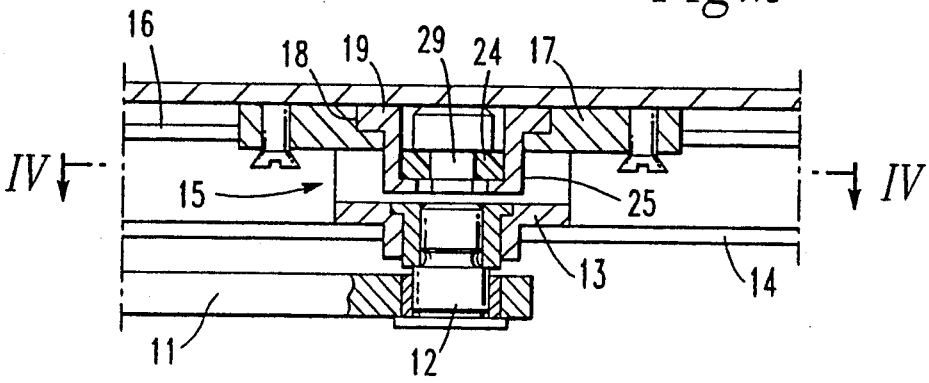
FIG. 2 shows the holding unit formed by the slide and abutment in the fixed position, in a longitudinal section analogous to FIG. 1.
Figure 3:
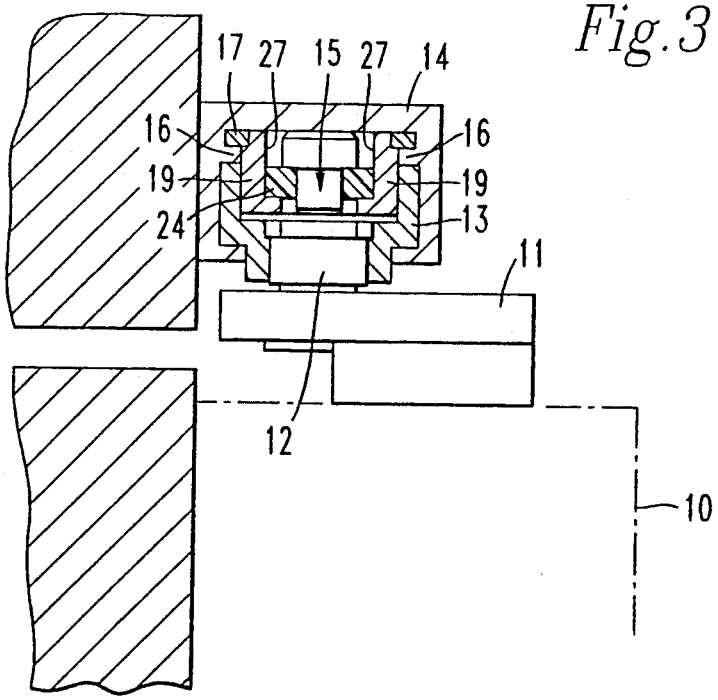
FIG. 3 shows the holding unit illustrated in FIG. 2, in cross section.
Figure 4:
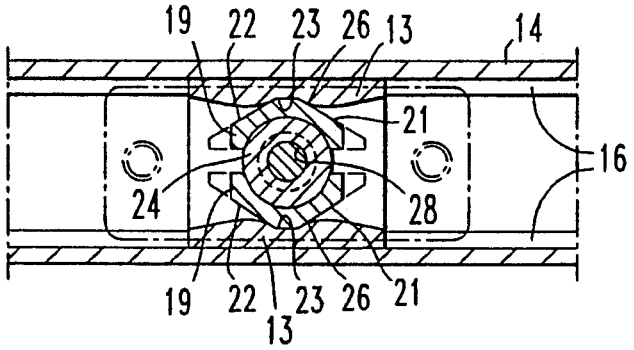
FIG. 4 shows the holding unit illustrated in FIG. 2, in a horizontal section along Line IV—IV in FIG. 2.

In the embodiment illustrated in FIGS. 2 to 4, the flat piece has, on its reverse side, a guide recess 18, in which are located the feet of two legs 19 designed as isosceles triangles and located at some distance from one another. As a result of their shape, these legs 19 have a leading bevel 21 and a trailing bevel 22, which in the area where they come into contact with one another, each may form a notch 23 or be engagable with a notch in the central region thereof. These legs 19, on their sides facing one another, each have a recess 27 preferably in the shape of a segment of a circle, which are filled by a buffer element 24 which provides elastic support for a leg 19. These two legs 19 which can be moved by the elastic buffer element 24 transverse to the longitudinal direction of the guide rail 14, along the length of the guide rail 14 may form a holding element 25 for the slide 13, which preferably has a U-shaped cross section. The projecting legs, which are in contact with the side walls of the guide rails, have, on the inside, a notch 26 which fits the catch 23 of the leg 19. In the direction of movement, the legs of the slide 13 are also designed so that they ascend from their outsides to the central notch 26, namely so that at the beginning of the encounter between the slide 13 and the leg 19, there is a small clearance. When the slide 13 slides on the legs 19, the latter are pressed together against the action of the biasing or buffer element 24, until they are finally able to engage in the notch 26 in the legs of the slide 13. The buffer element 24 preferably has a central hole 28, in which is engaged an inelastic pin which fills it up, with a positive and form fit, to increase the return force of the buffer element 24.

Figure 5:
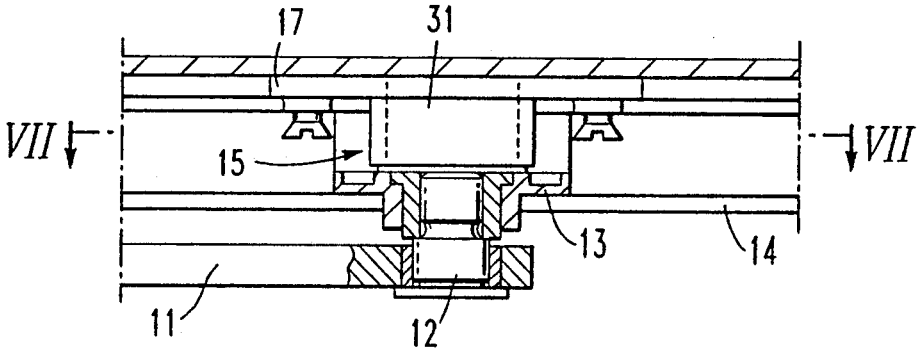
FIG. 5 shows an additional embodiment of the holding unit as in FIG. 2, in a vertical section.
Figure 6:
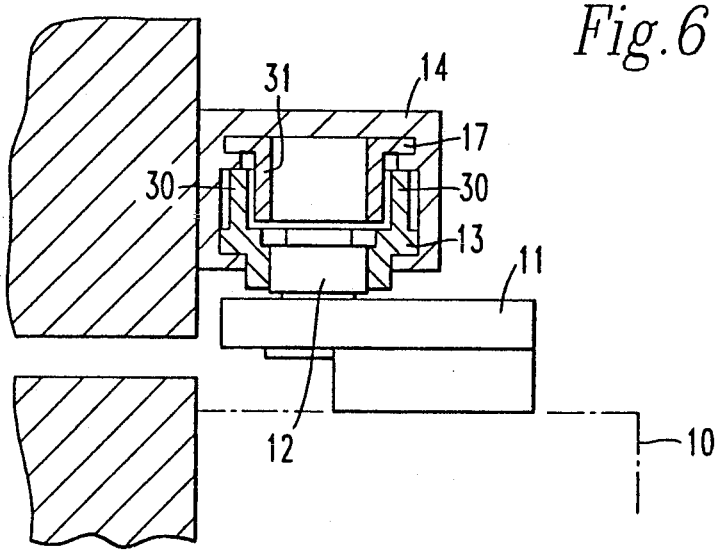
FIG. 6 shows the holding unit illustrated in FIG. 5, in cross section.
Figure 7:
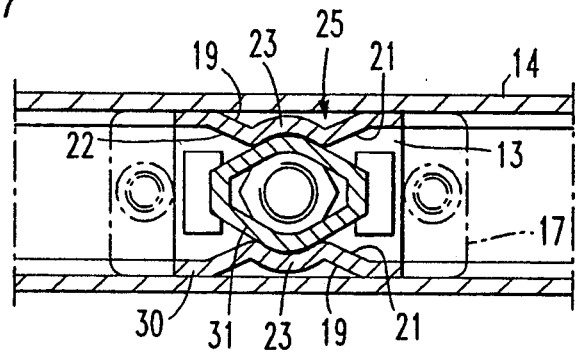
FIG. 7 shows the holding unit illustrated in FIG. 5 in a horizontal section along Line VII—VII in FIG. 5.

In the embodiment illustrated in FIGS. 5 to 7, an abutment 15 is also fastened in the guide rail 14, and together with the slide 13 forms a holding unit. This slide 13, also, is connected by means of a pin 12 fastened to it with the swivelling arm 11 of a door closer 10. In this embodiment, however, the side walls 30 located on both longitudinal sides of the slide 13 act as the holding element 25. These two side walls 30 have leading bevels 21 and trailing bevels 22 designed as elastic legs 21. Between each leading bevel 21 and the trailing bevel 22, a form-fitting catch 23 is formed. When the door is fixed, as illustrated in FIGS. 5 to 7, these catches 23 on the legs 19 of the slide 13 interact with a rhomboid or diamond-shaped projection 21 of the flat piece 17 which functions as the abutment 15.

Figure 8:
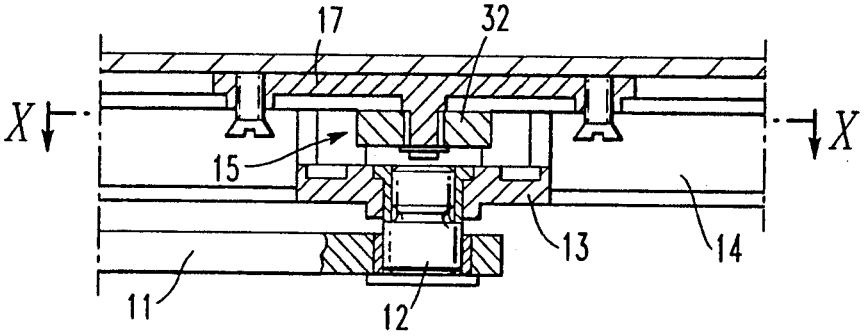
FIG. 8 shows an additional embodiment of a holding unit in a vertical section, as shown in FIGS. 2 and 5.
Figure 9:
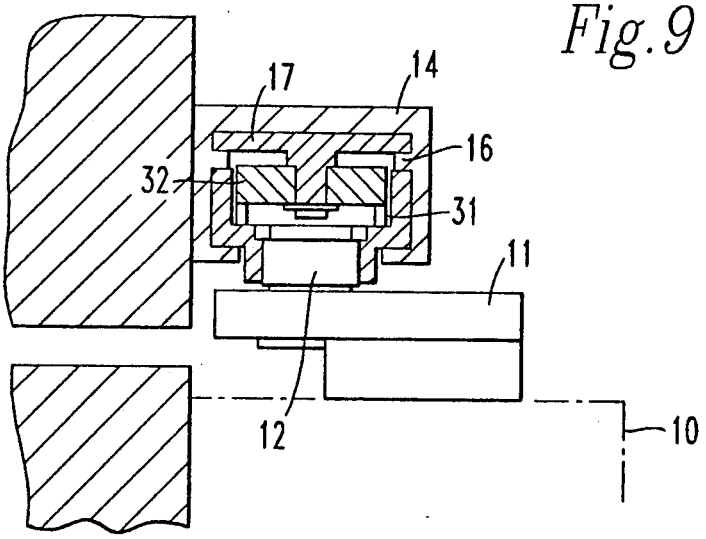
FIG. 9 shows the holding unit illustrated in FIG. 8, in a cross section.

The embodiment illustrated in FIGS. 8 to 10 is generally somewhat similar in the principle of operation as the embodiment described above and illustrated in FIGS. 5 to 7. One difference, however, is that the holding element 25 does not consist of legs formed in one piece on the slide 13, but the legs 19 forming the holding element 25 are designed as independent leaf springs 31 mounted on the sidewalls of the slide 13. Each leaf spring 31 in turn has a recoiling catch 23 designed as a recess which, when the door is fixed, positively encloses portions of a hard elastic circular disc 32 forming a abutment 15, and securely holds it in this position.

The embodiment disclosed in FIGS. 11 to 13 differs from the embodiment illustrated in FIGS. 5 to 7 in that there is a one-piece side wall formed into a leg 19 only on one side of the slide 13. This elastic leg 19 in turn has a leading bevel 21 and a trailing bevel 22, between which, in turn, the catch 23 is formed by an molded groove, in which, when the door is fixed, an angular leg 33 projecting from the flat piece abutment 15 is engaged. The angular leg 33 is shaped so that its legs slide along, depending on the direction of movement, either on the leading bevel 21 or on the trailing bevel 22, and that the tip of the angle between its legs is engaged in the notch 33 when the door is fixed. This situation is illustrated in particular in FIG. 13.

Figure 16:
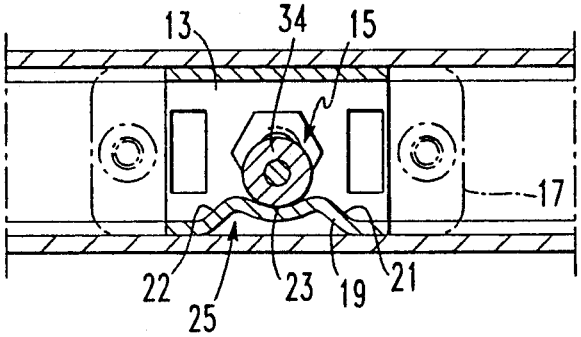
FIG. 16 shows the holding unit illustrated in FIG. 14, in a horizontal section along Line XVI—XVI in FIG. 14.

The embodiment illustrated in FIGS. 14 to 16 is essentially similar in its principal of operation as the embodiment illustrated in FIGS. 11 to 13. Hereagain, there is only a single elastic leg 19 on one of the two side walls of the slide 13, where the design and configuration of the leg are essentially the same as the leg 19 illustrated in FIG. 13. This leg also has a leading bevel 21 and a trailing bevel 22, between which, once again, the catch 23 is located in the form of a recess. On this holding element 25 corresponding to the slide 13, when the door is fixed, a hard elastic roller 34 forming an abutment 15 is engaged, when the slide 13 moves into the holding position illustrated in FIGS. 14 to 16. This roller 34 is mounted on an adjustable pin which is permanently connected to a flat piece 17 fixed in the rail 14 and offset in relation to the longitudinal center of the slide.

One feature of the invention resides broadly in a fixing device for door panels with a door closer, the closer shaft of which is coupled to one end of a swivel arm, the other end of which is engaged by means of a slide so that it can move longitudinally in a guide rail, and the slide together with an abutment fastened to the guide rail forms a holding unit to fix the door panel connected to the swivel arm, whereby the holding unit comprises an overthrusting, automatically yielding and resetting holding element, characterized by the fact that the holding element 25 has spring mounted legs 19 with a leading bevel 21 and a trailing bevel 22, which run together in a catch 23, and are engaged in a slide 13.

Another feature of the invention resides broadly in a fixing device, characterized by the fact that the abutment 15 is designed as a flat piece 17 fastened to the guide rail 14, which flat piece supports two legs 19 designed as isosceles triangles, which with the tips of their legs forming the catch 23 are oriented transverse to the longitudinal axis of the guide rail, and between which they hold an elastic buffer element 24 supporting the legs 19, by means of which buffer element 24, when the door is fixed, the notches 23 of the leg are held inside or between the leading bevel 21 and the trailing bevel 22 in notches 26 on the inside surface of the side walls of the slide 13.

Another feature of the invention resides broadly in a fixing device, characterized by the fact that the buffer element 24 is designed as a cylindrical disc, which is supported against recesses 27 which expand into a cylindrical hole in each leg 19.

Yet another feature of the invention resides broadly in a fixing device, characterized by the fact that the buffer element 24 has a central hole 28, in which there is an inelastic pin 29 which fills up said hole.

Still another feature of the invention resides broadly in a fixing device, characterized by the fact that the buffer element 24 is located exclusively in the area of action of the side walls of the slide 13 acting on the legs 19, when the door is fixed.

Another feature of the invention resides broadly in a fixing device, characterized by the fact that the holding element 25 is formed by side walls 30 of the slide 13 which form elastic legs 19, which with their notches 23, when the door is fixed, partly surround a rhomboid projection 31 of the flat piece abutment 15.

Yet another feature of the invention resides broadly in a fixing device, characterized by the fact that the legs 19 of the holding element 25 are formed out of the leaf springs 31 fastened on both sides of the slide 13, and these leaf springs 31, with their catches 23, surround portions of a hard elastic circular disc 32 mounted on the abutment 15.

Still another feature of the invention resides broadly in a fixing device, characterized by the fact that the slide 13 has an elastic leg 19 only on one side, in whose notch 23 an angular leg 33 projecting from the flat piece abutment 15 is engaged, when the door is fixed.

Another feature of the invention resides broadly in a fixing device, characterized by the fact that the slide 13 has an elastic leg 19 on only one side, in whose notch 23 a hard elastic roller 34 mounted on the flat piece abutment 15 is engaged, when the door is fixed.

All, or substantially all, of the components and methods of the various embodiments may be used in any combination with at least one embodiment or all of the embodiments described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A door closer apparatus being affixable to a door; said door closer apparatus comprising:

a channel, affixable to a member of a door mounting frame which is perpendicular to a plane passing through the hinge axis of the door, with said channel for being disposed parallel to the longitudinal axis of the frame member;

an arm extending from said door closer to said channel for closing a door;

said arm having a first end and a second end;

said door closer having detent apparatus for holding a door open;

said detent apparatus being affixable to a door mounting frame and to a door hinged from the door mounting frame to pivot the door about an axis from a normally closed position to an open position, and for detenting the door at a selected open position, said detent apparatus comprising:

a slide positioned inside the channel and slidable along the channel;

said arm pivotally connected at said first end to the said slide and operatively, pivotally connectable at said second end to the door at a point removed from the door hinge axis;

a detent member having mutually orthogonal longitudinal and lateral axes;

said detent member for being selectively positioned within said channel;

said slide and said detent member comprising in combination detent means;

said detent means comprising at least one surface having:

a) a leading level portion and a trailing bevel portion, and b) a catch portion between said leading bevel portion and said trailing bevel portion;

said catch portion joining said leading bevel portion and said trailing bevel portion with one another;

said bevel portions each having a lower portion and a raised portion;

said lower portions being disposed away from said catch portion and said raised portions being disposed against said catch portion;

said detent means comprising means for urging at least one of said slide and said detent member in contact with said catch portion and into a detent relationship with one another;

said slide and said detent member being configured so that said detent member extends into the path of said slide along the guide channel and being further configured so that said slide contacts said detent member as said slide moves within the channel said detent member being yet further configured so that said slide makes contact with said detent member at a position corresponding to a desired detent position of the door;

said detent means being configured to be substantially resilient but having sufficient rigidity to generally prevent said slide from being pulled past said detent member in the absence of external forces applied to the door;

wherein said detent bevel means portions are disposed on said slide; and wherein said detent means bevel portions are disposed on said detent portion;

said detent portion comprises an abutment, said abutment is configured to comprise a flat piece being fastened to the guide rail, said abutment comprises two legs configured to form an isosceles triangle configuration to form said bevel portions, said triangle configuration having a tip where said legs join; said tip forming at least a portion of said catch portion;

said tip forming a line, said line oriented transverse to the longitudinal axis of said channel of said guide rail;

said urging means configured for urging said abutment into contact with said slide to engage at least a portion of said catch portion with said slide.

2. Apparatus according to claim 1, wherein each of said legs have a tip; said urging means comprise an elastic buffer element supporting said legs;

said slide also comprising, on each side thereof, a leading bevel portion and a trailing bevel portion;

a notch, formed between each leading bevel portion and trailing bevel portion of said slide, to form at least a part of said catch portion;

said buffer element being disposed between said two legs for urging the tips of said legs into each said notch in said slide when said door is in the detent position;

said buffer element comprises a cylindrical disc, said legs form a cylindrical hole portion for receiving said disc, said detent member has recesses said disc is supported against said recesses, said disc being configured for expanding into said cylindrical hole portion in said legs;

said buffer element has a central hole, in which hole there is an inelastic pin which fills up said hole.

3. Apparatus according to claim 1, wherein said slide comprises said means for urging; said bevels are formed by walls of said slide, said bevels comprising at least a portion of said urging means, said bevels being configured as elastic legs, said catch portion formed as a notch between said bevel portions, said detent member comprising a rhomboid projection for being disposed in said notch when the door is fixed.

4. Apparatus according to claim 1, wherein said slide comprises said means for urging; said bevels are formed by walls of said slide, said bevels comprising at least a portion of said urging means, said bevels being configured as elastic legs, said catch portion formed as a notch between said bevel portions, said detent member comprising a hard elastic circular disc for being disposed in said notch when the door is fixed.

5. Apparatus according to claim 1, wherein said slide comprises said means for urging, said bevels are formed by a wall on only one side of said slide, said bevels comprising at least a portion of said urging means, said bevels being configured as elastic legs, said catch portion formed as a notch between said bevel portions, said detent member comprising a hard elastic circular disc for being disposed in said notch when the door is fixed.

6. A door closer apparatus being affixable to a door; said door closer apparatus comprising:

a channel, affixable to a member of a door mounting frame which is perpendicular to a plane passing through the hinge axis of the door, with said channel for being disposed parallel to the longitudinal axis of the frame member;

an arm extending from said door closer to said channel for closing a door;

said arm having a first end and a second end;

said door closer having detent apparatus for holding a door open;

said detent apparatus being affixable to a door mounting frame and to a door hinged from the door mounting frame to pivot the door about an axis from a normally closed position to an open position, and for detenting the door at a selected open position, said detent apparatus comprising:

a slide positioned inside the channel and slidable along the channel;

said arm pivotally connected at said first end to the said slide and operatively, pivotally connectable at said second end to the door at a point removed from the door hinge axis;

a detent member having mutually orthogonal longitudinal and lateral axes;

said detent member for being selectively positioned within said channel;

said slide and said detent member comprising in combination detent means;

said detent means comprising at least one surface having:

a) a leading bevel portion and a trailing bevel portion, and b) a catch portion between said leading bevel portion and said trailing bevel portion;

said catch portion joining said leading bevel portion and said trailing bevel portion with one another;

said bevel portions each having a lower portion and a raised portion;

said lower portions being disposed away from said catch portion and said raised portions being disposed against said catch portion;

said detent means comprising means for urging at least one of said slide and said detent member in contact with said catch portion and into a detent relationship with one another;

said slide and said detent member being configured so that said detent member extends into the path of said slide along the guide channel and being further configured so that said slide contacts said detent member as said slide moves within the channel and said detent member being yet further configured so that said slide makes contact with said detent member at a position corresponding to a desired detent position of the door;

said detent means being configured to be substantially resilient but having sufficient rigidity to generally prevent said slide from being pulled past said detent member in the absence of external forces applied to the door;

wherein said detent bevel means portions are disposed on said slide; and wherein said slide comprises said means for urging; said bevels are formed by a wall on only one side of said slide, said bevels comprising at least a portion of said urging means, said bevels being configured as elastic legs, said catch portion formed as a notch between said bevel portions, said detent member comprising an angular leg for being disposed in said notch when the door is fixed; said detent member comprising a portion having at least one flat surface from which said angular leg projects.

7. Apparatus for holding a door open, said apparatus being affixable to a door mounting frame and to a door hinged from the door mounting frame to pivot the door about an axis from a normally closed position to an open position, and for detenting the door at a selected open position, said apparatus comprising:

a guide rail comprising a channel;

said channel, affixable to a member of a door mounting frame which is perpendicular to a plane passing through the hinge axis of the door;

said channel having a longitudinal axis for being disposed parallel to the longitudinal axis of the frame member;

said channel having a slot extending along a wall of the channel;

a slide positioned inside the channel and slidable along the channel;

an arm having a first end and a second end;

said arm pivotally connected at said first end to the said slide and operatively, pivotally connectable at said second end to the door at a point removed from the door hinge axis;

a detent member having mutually orthogonal longitudinal and lateral axes;

said detent member for being selectively positioned within said channel proximate the slotted wall of said channel within said channel;

said slide and said detent member comprising in combination detent means;

said detent means comprising at least one surface having a leading bevel portion and a trailing bevel portion and a catch portion between said leading bevel portion and said trailing bevel portion;

said catch portion joining said leading bevel portion and said trailing bevel portion with one another;

said bevel portions each having a lower portion and a raised portion;

said lower portions being disposed away from said catch portion and said raised portions being disposed proximate said catch portion;

said detent means comprising means for urging at least one of said slide and said detent member in contact with said catch portion and into a detent relationship with one another;

said slide and said detent member being configured so that said detent member extends into the path of said slide along the guide channel and further configured so that said slide contacts said detent member as said slide moves within the channel and said detent member being yet further configured so that said slide makes contact with said detent member at a position corresponding to a desired detent position of the door;

said detent means being configured to be substantially resilient but having sufficient rigidity to generally prevent said slide from being pulled past the said detent member in the absence of external forces applied to the door;

wherein said detent bevel means portions are disposed on said slide;

wherein said detent bevel means portions are disposed on said detent portion;

wherein said detent portion comprises an abutment, said abutment is configured to comprise a flat piece being fastened to the guide rail, said abutment comprises two legs configured to form an isosceles triangle configuration to form said bevel portions, said triangle configuration having a tip where said legs join; said tip forming at least a portion of said catch portion;

said tip forming a line, said line oriented transverse to the longitudinal axis of said channel of said guide rail; and said urging means configured for urging said abutment into contact with said slide to engage at least a portion of said catch portion with said slide.

8. Apparatus according to claim 7, wherein each of said legs have a tip; said urging means comprise an elastic buffer element supporting said legs;

said slide also comprising, on each side thereof, a leading bevel portion and a trailing bevel portion;

a notch, formed between each leading bevel portion and trailing bevel portion of said slide, to form at least a part of said catch portion;

said buffer element being disposed between said two legs for urging the tips of said legs into each said notch in said slide when said door is in the detent position.

9. Apparatus according to claim 8, wherein said buffer element comprises a cylindrical disc, said legs form a cylindrical hole portion for receiving said disc, said detent member has recesses said disc is supported against said recesses, said disc being configured for expanding into said cylindrical hole portion in said legs.

10. Apparatus according to claim 9, wherein said buffer element has a central hole, in which hole there is an inelastic pin which fills up said hole.

11. Apparatus according to claim 7, wherein said slide comprises said means for urging; and bevels are formed by walls of said slide, said bevels comprising at least a portion of said urging means, said bevels being configured as elastic legs, said catch portion formed as a notch between said bevel portions, said detent member comprising a rhomboid projection for being disposed in said notch when the door is fixed.

12. Apparatus according to claim 7, wherein said slide comprises said means for urging; said bevels are formed by walls of said slide, said bevels comprising at least a portion of said urging means, said bevels being configured as elastic legs, said catch portion formed as a notch between said bevel portions, said detent member comprising a hard elastic circular disc for being disposed in said notch when the door is fixed.

13. Apparatus according to claim 7, wherein said slide comprises said means for urging; said bevels are formed by a wall on only one side of said slide, said bevels comprising at least a portion of said urging means, said bevels being configured as elastic legs, said catch portion formed as a notch between said bevel portions, said detent member comprising an angular leg for being disposed in said notch when the door is fixed; said detent member comprising a portion having at least one flat surface from which said angular leg projects.

14. Apparatus according to claim 5, wherein said slide comprises said means for urging; said bevels are formed by a wall on only one side of said slide, said bevels comprising at least a portion of said urging means, said bevels being configured as elastic legs, said catch portion formed as a notch between said bevel portions, said detent member comprising a hard elastic circular disc for being disposed in said notch when the door is fixed.

* * * * *

UNITED STATES PATENT AND TRADEMARK OFFICE

CERTIFICATE OF CORRECTION

PATENT NO. : 5,311,642

DATED : May 17, 1994

INVENTOR(S) : Horst TILLMANN, Dietrich JENTSCH, Thomas HERING, Thomas WARSCHEWITZ, Dieter SICHELSCHMIDT, and Bernd WINKLER It is certified that error appears in the above-indentified patent and that said Letters Patent is hereby corrected as shown below:

In column 7, line 14, Claim 1, after 'channel' insert --and--.

In column 12, line 3, Claim 14, after 'claim', delete "5," and insert --7,--.

Signed and Sealed this

Twelfth Day of November, 1996

*Attest:*

*Attesting Officer*

BRUCE LEHMAN

*Commissioner of Patents and Trademarks*